United States Patent [19]

Ford

[11] Patent Number: 4,651,908

[45] Date of Patent: Mar. 24, 1987

[54] BOW MAKING FORM

[76] Inventor: Richard L. Ford, P.O. Box 367, Dexter, Mo. 63841

[21] Appl. No.: 788,866

[22] Filed: Oct. 18, 1985

[51] Int. Cl.[4] ..... A41H 43/00

[52] U.S. Cl. ..... 223/46; 28/150

[58] Field of Search ..... 223/46; 28/147, 150

[56] References Cited

U.S. PATENT DOCUMENTS

| | | | |
|---|---|---|---|
| 1,442,124 | 1/1923 | Buckley | 28/150 |
| 2,860,399 | 11/1958 | Bates | 28/150 |
| 3,021,038 | 2/1962 | Dean | 223/46 |
| 3,193,162 | 7/1965 | Montoya | 223/46 |
| 3,229,870 | 1/1966 | Capstick | 223/46 |

OTHER PUBLICATIONS

"Bow Making Form Instructions", by Richard L. Ford, P.O. Box 367, Dexter Mo. 63841.

*Primary Examiner*—Louis K. Rimrodt

[57] ABSTRACT

An improved form for making ribbon bows provided with large flexible star points, the improvement comprising small star points alternately spaced between the larger star points.

1 Claim, 4 Drawing Figures

BOW MAKING FORM

This invention relates to a tool and method for arranging decorative ribbon material by hand and particularly to the manual formation of decorative bows.

A primary object of this invention is to provide a form or tool whereby the making of decorative ribbon bows is facilitated. For years now, professional looking bows for gift wrapping and decorations, or the like, are generally made on expensive automatic bow making machines. Such machines are relatively expensive and do not find wide acceptance in the home or in small stores where infrequent use would normally not justify the initial investment. Various forms have been designed to facilitate this operation, but hitherto, these have been marked by complexity of form and difficulty of manipulation so that the tying of ribbon bows has been a difficult operation requiring considerable skill. It is the purpose of this invention to provide an inexpensive tool for making ribbon bows in the home.

In viewing all of the previous patents pertinent to the prior art to this invention, there are only a couple who have any bearing on the subject matter. These being crude in their nature and being time consuming and difficult to form.

As conducive to a clearer understanding of this invention, it may be pointed out that the prior art differs in many ways, primarily to their lack of knowledge as to this newer and more novel invention. First U.S. Pat. No. 3,021,038 uses a plastic form, the only common element similar to this invention other than it has a hole in the center. The form is shaped completely different and the finished bow does not look similar. Also, the bow has a knot in the bottom like a bouquet caused by stapling and will not lay flat.

Secondly, the Capstick U.S. Pat. No. 3,229,870 uses a plastic form of a quite different shape and a different method of formation. It has long legs with bevels or sharp angle points on the end of each leg that requires that the ribbon be hung or hooked midway and balanced on the end of a chamferred leg. This requires some doing using plastic ribbon and can only be hung around each leg end one time and not easily then.

This invention being unlike the above mentioned Capstick patent in that the ribbon is not hung, hooked or suspended or centered on the end of any chamferred leg, post or star points, thereby making its formation easier. It merely loops easily around the star points without pressure being necessary. Also, the star points, unlike the prior art, can be successively looped as many times as desired, thereby, allowing the bows to have a multiple number of layers or loops, thus, making a more fully formed bow.

The applied for invention has a distinctive advantage in that it has a circular hole in the middle which facilitates the binding of the bow together by stapling through the ribbon before removing the formation from the form, thus, allowing for a permanent bonding of the bow before it is removed from the form. This is unlike the Capstick patent which does not have a hole; which requires a thumbtack for holding the ribbon and which requires that the entire ribbon formation be carefully removed from the form before the bow can be stapled and bound together. It is hard to comprehend that in the Capstick method five or more loops must be removed from the form by hand and held in position without movement before the formation can be stapled together. Indeed, not a simple task for one not trained in the art.

The Capstick patent has an awkward form and is difficult in its formation, unlike this invention, and requires a considerable amount of time.

In accordance with this invention there is provided a simple star workbase or form for use in making loops of a decorative ribbon material and arranging them into a professional looking bow with a minimum of effort and maximum effect.

In accordance with this invention, a bowmaking form or tool is provided for making ribbon bows comprising of a flat plastic plate having a central circular opening therein with an angular cut notch just below the center hole, and a series of five star points projecting substantially radially with respect to means for temporarily holding ribbon from which the bow is being made. The legs or points are of such length and flexibility that when the bow is made, the points can be flexed toward the bow to release the loops of the bow without stretching too far or otherwise damaging or distorting the appearance of the bow.

Thus, in accordance with the invention, a method of making decorative ribbon formations is disclosed wherein decorative ribbon material is attached to a rotatable work surface; the work surface is rotated by hand through increments using successive measure lengths of the standing portion of the ribbon material having sufficient stiffness to impart a torsional force to the work surface in the process of developing loops therein; and sequentially attaching the loops, thus, formed to the work surface upon each increment of rotation whereby evenly formed loops are layed out in an ornamental formation.

The entire tool may be formed with a flat sheet of single ply cardboard or for more durability hi-impact polystryrene plastic or vinyl with a thickness of thirty thousands or there abouts for the right flexibility. The form should be die cut for the best results, however, it may be cut by other means or molded.

Selecting a ribbon material is largely up to the individual, but, for illustration only, it will be assumed that a three quarter inch wide ribbon is chosen of the general commercial plastic variety which has both sides being glossy.

This particular starbow maker illustrated has a four and one half inch diameter and works fine using the three fourth inch wide ribbon. To change the diameter of the starbow maker would affect the size of the ribbon that could be used as well as the size of the finished bow.

This bow invention is also greatly aided by the center hole and the angular cut notch, just below the center opening. These two elements greatly increase the speed, effectiveness and the convenience of hand forming the bow.

The main principle that makes this invention work is the proper angle of the star points as to their relative width at their base. The shape of each point being all important. In appearance each star point resembling the near full pitch of a steep church roof. This degree of angle can be incorporated into a fewer or a greater number of star points.

Figure 1:
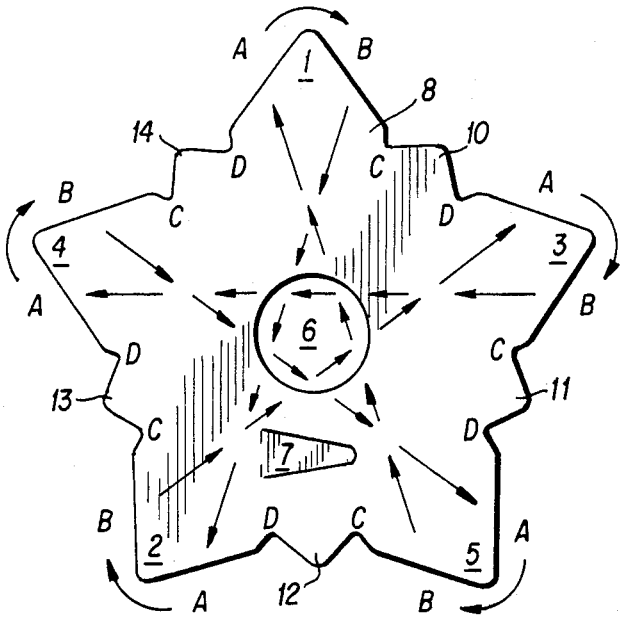
FIG. 1 is a view of the star bow maker form.
Figure 2:
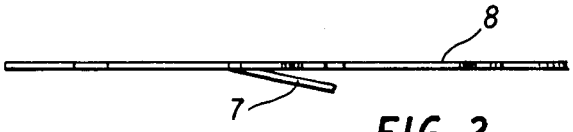
FIG. 2 is a view of the edge of the star bow maker.
Figure 3:
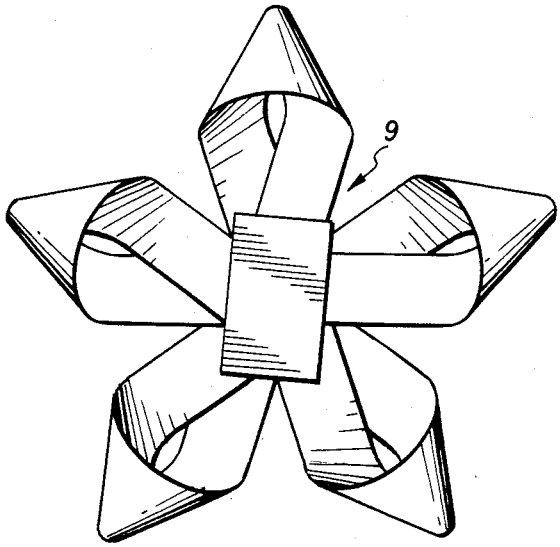
FIG. 3 is a view of a 4 ply bow with center loop before the radial loops have been pulled out.

The best prescribed method for making the decorative bow using this form is described in the hereafter material. The form 8 has five large star points, 1–5, each having sides A and B, projecting radically around the outer edge of the form and symmetrically arranged about a center opening 6. Alternately spaced between the larger star points 1–5 are small star points 10,11,12,13, and 14. The base of each star point creates a notch or nick, C and D, between each large star point 1–5. The small star points 10–14 are seen to inherently give the ribbon loops a stopping point and spacing distance between the larger star oiints 1–5 and will inherently hold the ribbon loops in place. It should be noted from the drawing that the relationship and width of the star points is such that the ribbon. must be drawn from the leading edge of one star point across the center of the form to the trailing edge of an opposed cooperating star point. Actually, the ribbon is making a route or eight shaped figure.

One must begin by taking two strips of plastic ribbon, each three fourths of an inch wide and five feet long, holding one end of the two pieces of ribbon together, insert the ribbon through center hole 6 downwardly toward clip 7. Then pull the ribbon through clip and let free end of ribbon hang two inches below edge of star between star points two and five.

In accordance with the preferred method, take standing portion of ribbon and loop over end of star point 1 by coming around A underneath to B down across 6 center hole to star, point 2 around A underneath to B down across 6 center hole to star point 3 around A underneath to B down across 6 center hole to star point 4 around A underneath to B down and across center hole 6 to star point 5 around A underneath to B and across 6 centerhole.

Figure 4:
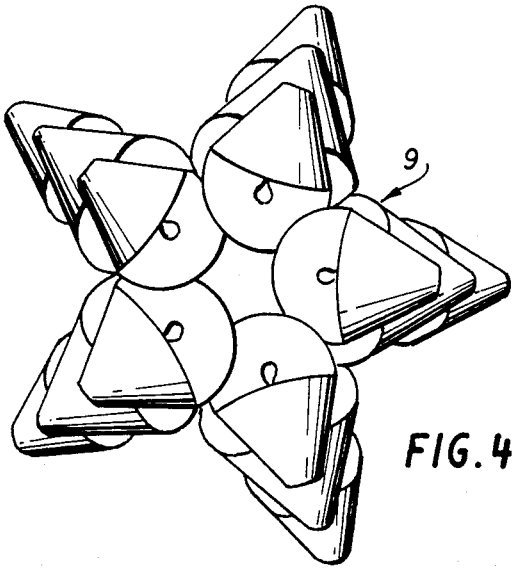
FIG. 4 is the view of a completed 4 ply bow similar to FIG. 3 except all of the loops have been spread open.

The above steps are repetitious from star point 1 through star point 5. The above paragraph only describes when the two strips of ribbon have been looped around the star points one time each. However, by using two ribbons at the same time this made two loops to each point. For the best and fullest appearance of the bow, four loops per star point is recommended. Therefore, for the bigger bow, as shown in FIG. 4, the above procedure should be carried on one more time around the five star points as mentioned in the previous description. After the ribbon run has finished the looping of star point 5 for the second time and underneath and around B across the center to 6 center hole, take a stapler and staple through center hole 6, thereby binding all of the loops of ribbon together.

Now remove the plastic star bow maker from the ribbon by pulling the ribbon free from the points of the star bow maker; next take the two inch loose free end of the ribbon stub and loop it up in center of bow and staple.

The bow is now made except for the star points of the bow needing to be flipped or pulled out into a full spread.

This new star bow invention only requires an inexpensive form, the appropriate ribbon and a common household stapler plus the knowledgeable method of arrangement of formation of the bow.

It is also a purpose of the invention to prescribe a method by which the invention may be practiced that employs novel steps which will enable all relatively unskilled persons to turn out high quality bows or the like of substantially duplicate size, shape and appearance.

This invention provides for a process through the use of a plastic plate or form whereby decorative bows can be made by hand inexpensively and quickly by a person not particularly gifted in bow making. Said bowmaker comprising of four elements to work at its best.

A. A form with the proper angle of star points relative to their base.

B. A centered hole in this form to facilitate the bow binding and release.

C. A cut angle in the form below the center hole for holding the free end of the ribbon.

D. The method for circulating around the star points.

The invention could still function without elements 6 & 7, but at a great cost in convenience and time. Without element 6 the bow would have to be removed by hand from the form before stapling in the center. Without element 7 the left thumb of the operator would have to be pressed continuously on the ribbon or else the ribbon might slip loose at the free end. This invention offers a simple and easy way to make bows that will be very inexpensive and can be used in every household. This simple plastic form can be produced and given away free as a means of advertisement or sold to the public for a small nominal charge.

Therefore, the main object of the invention is to provide a simple and inexpensive tool and a method wherein persons not particularly gifted in the art of making ribbon decorations will be able to make professional looking bows.

The technique used for bow making on this form is simple when explained, but still is not obvious even to one skilled in the trade without the proper instruction. It takes both this unique and novel form, and the correct method for completion.

I claim:

1. An improved form for making ribbon bows comprising a flat form having a round center opening therein and a series of large flexible star points projecting radically and symmetrically around the outer edge of said form for temporarily holding loops of ribbon from which the bow is being made, said star points being of such length and flexibility that when the bow is complete the points can be flexed toward the center of said form to release the loops of the bow, and an angular cut notch adjacent the center opening to anchor the ribbon end therein, the improvement comprising small star points alternately spaced between the larger star points.

* * * * *